US009068705B1

(12) United States Patent
Carter

(10) Patent No.: US 9,068,705 B1
(45) Date of Patent: Jun. 30, 2015

(54) 9-VOLT BATTERY MOUNTED FLASHLIGHT

(76) Inventor: Robert L. Carter, Naperville, IL (US)

( * ) Notice: Subject to any disclaimer, the term of this patent is extended or adjusted under 35 U.S.C. 154(b) by 1607 days.

(21) Appl. No.: 12/285,712

(22) Filed: Oct. 7, 2008

(51) Int. Cl.

| | |
|---|---|
| ***F21L 4/00*** | (2006.01) |
| ***F21V 1/00*** | (2006.01) |
| ***F21L 4/08*** | (2006.01) |
| *F21L 4/02* | (2006.01) |

(52) U.S. Cl.
CPC ..... *F21L 15/06* (2013.01); *F21L 15/00* (2013.01); *F21L 4/00* (2013.01); *F21L 4/085* (2013.01); *F21L 4/08* (2013.01); *F21L 4/027* (2013.01)

(58) Field of Classification Search
CPC ..... F21L 15/06; F21L 15/00; F21L 4/00; F21L 4/027; F21L 4/085; F21L 4/08; F21L 7/00; F21Y 2101/02
USPC ..... 362/194, 195, 183, 184, 208
See application file for complete search history.

(56) References Cited

U.S. PATENT DOCUMENTS

| | | | | |
|---|---|---|---|---|
| 4,459,646 | A * | 7/1984 | Drane | 362/199 |
| 5,097,399 | A * | 3/1992 | Gammache | 362/197 |
| 5,278,739 | A * | 1/1994 | Gammache | 362/197 |
| 5,521,803 | A * | 5/1996 | Eckert et al. | 362/198 |
| 6,109,763 | A * | 8/2000 | Ohta et al. | 362/205 |
| 6,457,841 | B1 * | 10/2002 | Lynch et al. | 362/199 |
| 6,840,650 | B2 * | 1/2005 | Parsons et al. | 362/196 |
| 6,893,142 | B2 * | 5/2005 | Collins | 362/195 |
| 7,229,189 | B2 * | 6/2007 | Parker et al. | 362/199 |
| 7,731,385 | B2 * | 6/2010 | Spartano et al. | 362/197 |

* cited by examiner

*Primary Examiner* — Jong-Suk (James) Lee
*Assistant Examiner* — Mark Tsidulko
(74) *Attorney, Agent, or Firm* — Dillis V. Allen, Esq.

(57) ABSTRACT

A 9-volt battery mounted flashlight including a lower housing fixedly mounted on the battery and an upper housing carrying an LED that pivots or rocks on the lower housing to turn the flashlight on and off. The upper housing has a pair of integral pivot bosses that mount in horizontal pivot bores in the lower housing so the upper housing rocks between on and off positions.

15 Claims, 8 Drawing Sheets

9-VOLT BATTERY MOUNTED FLASHLIGHT

BACKGROUND OF THE INVENTION 9-volt battery supported LED flashlights have been marketed for about the last seven years. The principal advantage of these flashlights is because they are supported on and atop the 9 volt battery, they eliminate the need for a flashlight body holding the batteries, they eliminate the need for a removable bulb holding assembly, they eliminate the need for a light reflector and they eliminate the need for a lens and lens bezel.

The companies currently manufacturing battery mounted flashlights have not optimized the market for these products because: (1) their product design is not cost sensitive; (2) their product design is not durable; and (3) they have not designed and promoted the product in its optimal markets.

The first technical entry into the battery supported flashlight market is shown in the Puppo, U.S. Pat. No. 6,137,398, filed on Oct. 15, 1999, entitled "Miniature Battery Powered Beacon". This device includes a base 12 carrying terminals 26 and 28 and a top mounted LED 14 covered by a cap 30. There is no switch in the Puppo device and the only way to shut the Puppo "Beacon" off is to remove the flashlight from the battery. Besides the cumbersome maneuver of snapping the flashlight on and off the battery just to shut the light off, because the flashlight is so small, when it is off the battery it is frequently misplaced or lost. This is not a good design.

Benjamin Victor Duane Henry, in his U.S. Pat. No. 6,511,202 entitled "Light Emitting Diode 9-volt Battery Snap Flashlight", came up with the idea of adding a switch to the Puppo design, but the incremental cost of the switch itself makes Henry's design non-competitive in the marketplace.

Then came John Collins (U.S. Pat. No. 6,695,459, entitled "Portable Lighting Product, Portable Lighting Product Circuitry, and Method for Switching Portable Lighting Product Circuitry), in 2002 and devised a switchless battery mounted flashlight that pivots on one of the battery terminals to engage the other battery terminal to turn the flashlight on and off. The base 40, as seen in FIG. 8, carries a terminal 56 that clamps on and pivots with respect to the battery terminal 22. The wire 47 clips on the other battery terminal selectively to turn the flashlight on and off as the base pivots on a vertical, not horizontal, axis.

The biggest problem with the Collins design is stability. When the switch is off as depicted in FIG. 8, the base 40 is solely supported on one battery contact, contact 22, and the base is swung perpendicular to and overhanging the battery. It cannot be carried in that position because it will easily snap off the battery and damage the base terminal connection.

Furthermore, when in use the Collins device feels and appears flimsy and of low quality.

It is a primary object of the present invention to ameliorate the problems noted above in battery mounted flashlights.

SUMMARY OF THE PRESENT INVENTION

In accordance with the present invention, a 9-volt battery mounted flashlight is provided including a lower housing fixedly mounted on the battery and an upper housing carrying an LED that pivots or rocks on the lower housing to turn the flashlight on and off. The upper housing has a pair of integral pivot bosses that mount in horizontal pivot bores in the lower housing so the upper housing rocks between on and off positions.

The principal advantages of the present invention are low cost and stability. The low cost is provided by the one-piece upper and lower housings and the elimination of a self-standing switch. The rocking motion of the upper housing provides the switching function at a lower cost. The stability is provided by the lower housing which snaps onto both positive and negative terminals of the battery to lock the lower housing on the battery without relative movement therebetween such as in the Collins portable lighting product discussed above. Further stability is provided by the recess in the top of the lower housing that receives and guides the upper housing as it rocks from on to off positions in the lower housing.

This flashlight has many uses such as a home emergency light, a camping light, or with red flashing LEDs, a vehicle warning light. One ideal marketing of this product is with of 9-volt batteries at the point of sale of the batteries, either inside or outside of the battery packaging.

This flashlight, properly made and designed, can be manufactured at a cost of approximately $0.30 at a given labor rate, by far cutting the cost of currently marketed battery mounted flashlights.

DETAILED DESCRIPTION OF THE PREFERRED EMBODIMENT

Figure 1:
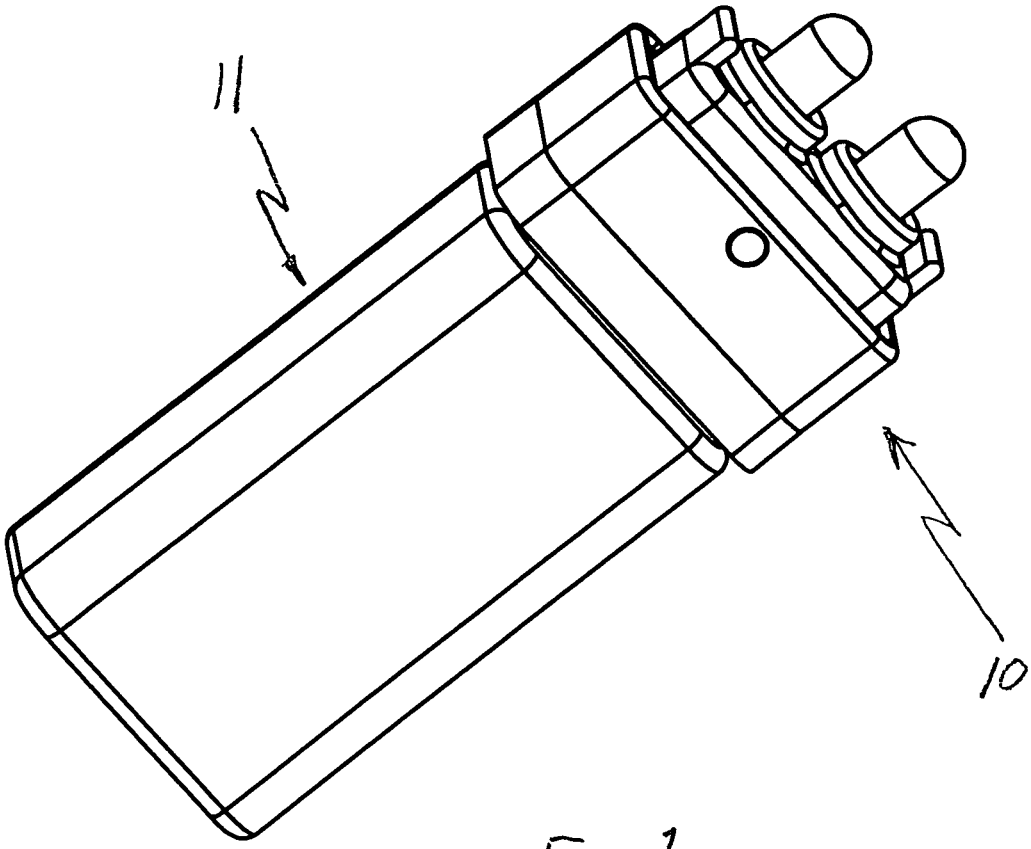
FIG. 1 is a perspective view of the present light assembly shown snapped onto the contacts of a standard 9-volt battery.

Referring to the drawings and particularly FIGS. 1 to 4, the present light assembly is generally designated by the reference numeral 10, and as illustrated in FIG. 1 is releasably snapped to the top contacts of a standard 9-volt battery 11.

Figure 2:
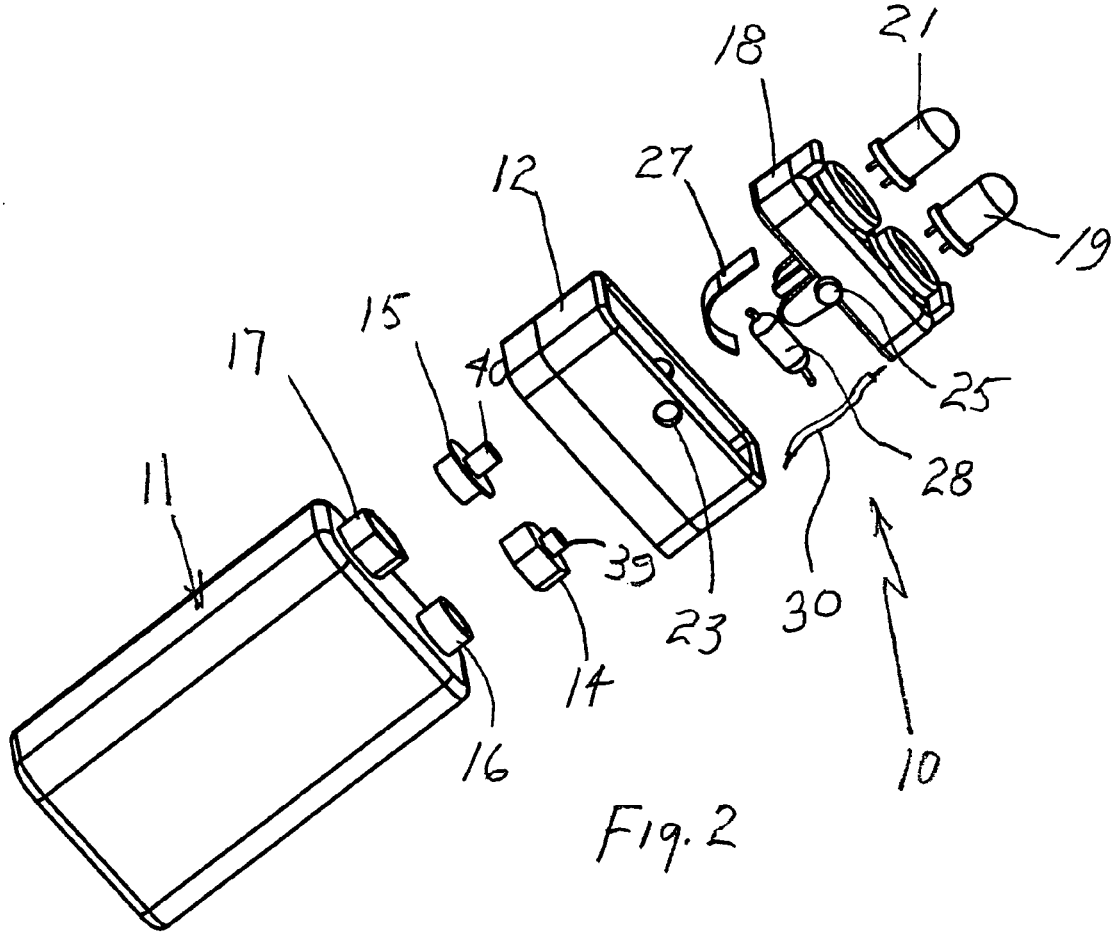
FIG. 2 is an exploded view of the light assembly and battery illustrated in FIG. 1.

As seen more clearly in the exploded view of FIG. 2, the light assembly 10 includes a stationary bottom housing 12 carrying a positive contact or terminal 14 and a negative contact or terminal 15 that snap respectively onto positive battery contact or terminal 16 and negative battery contact or terminal 17.

Also seen in FIG. 2 a "J" contact 27 is provided that selectively engages the negative contact 15 to turn the light assembly on and off, a resistor 28 provides the necessary voltage drop to the LEDs 19 and 21, and a conductive wire 30 provides electrical contact between the positive contact 14 and one of the leads of resistor 28. A coil spring may be an alternative to "J" contact 27.

An upper housing 18 carries LEDs 19 and 21 and is pivotally mounted in lower housing apertures 23 by integral opposed circular mounting bosses 25. The pivotal movement of the upper housing 18 within the lower housing 12 is what causes actuation and deactuation of the LEDs 19 and 21.

Figure 3:
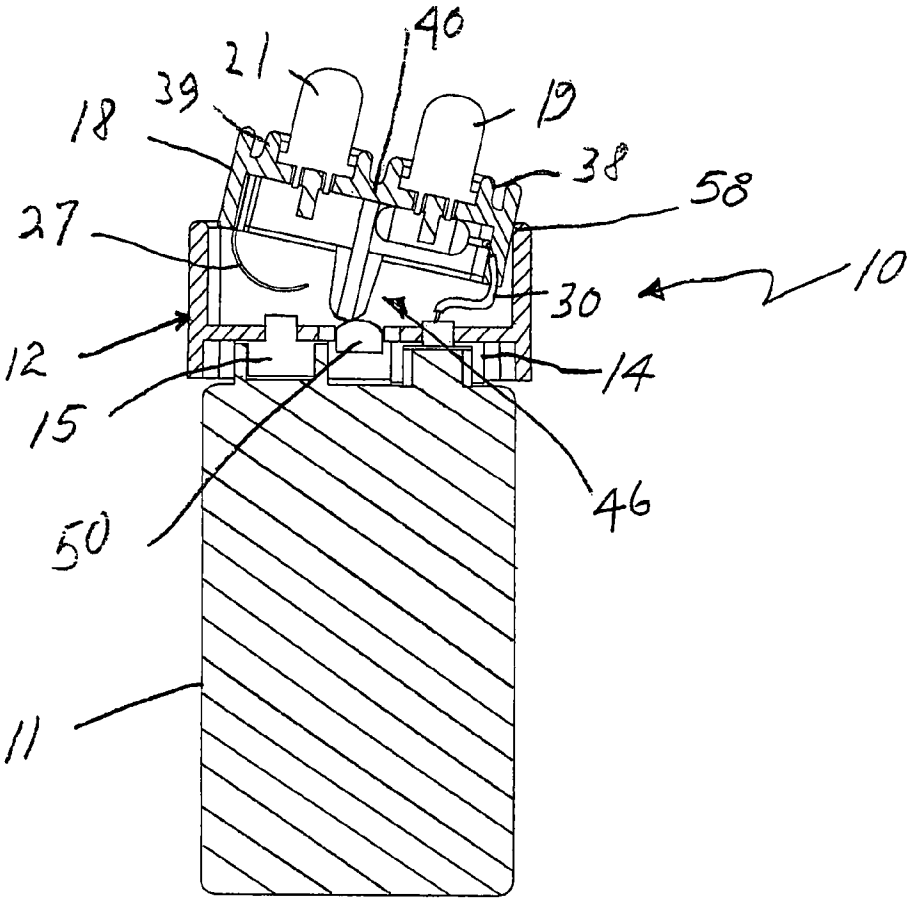
FIG. 3 is a longitudinal section through the light assembly and battery showing the light assembly in its "off" position.

The light assembly 10 is illustrated in FIG. 3 in its "off" position, with "J" contact 27 apart from the negative light assembly contact 15.

Figure 7:
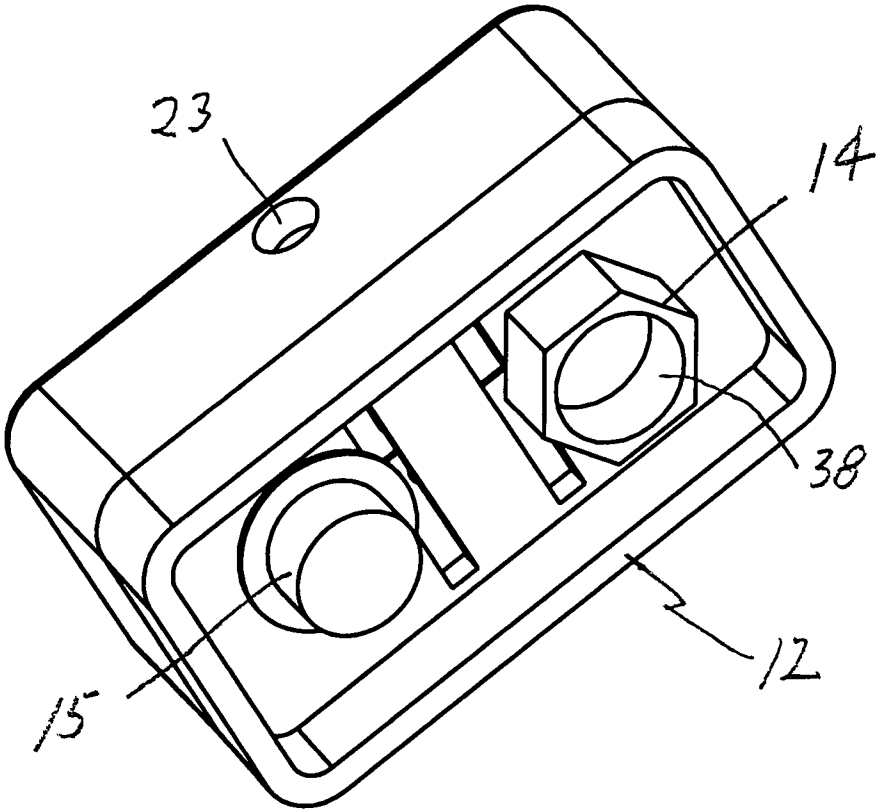
FIG. 7 is a bottom perspective of the bottom housing assembly.
Figure 8:
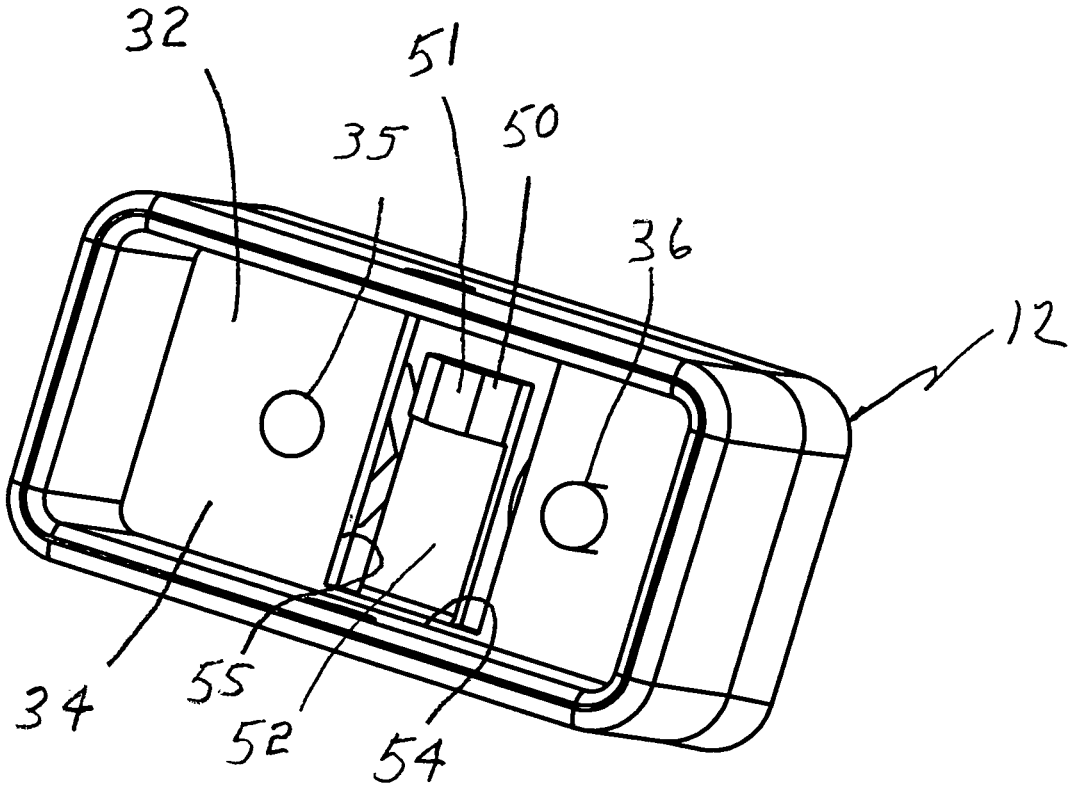
FIG. 8 is a top perspective of the bottom housing assembly.

As seen in FIGS. 3, 7, and 8, the lower housing 12 is a one-piece plastic molding that is generally rectangular in construction having an upper rectangular recess 32 that pivotally receives and guides the upper housing 18. As seen in FIG. 8, the lower housing has a transverse wall 34 with a pair of through bores therethrough 35 and 36, that receive the stems 39 and 40 of contacts 14 and 15 respectively. The contacts are riveted in bores 35 and 36. As seen more clearly in FIG. 7, positive contact 14 is hexagonal in configuration and has a bore 38 therein that snaps over battery positive terminal 16, while contact 15 is a male member that fits within negative battery terminal 17, as seen clearly in the sectional views of FIGS. 3 and 4.

Figure 4:
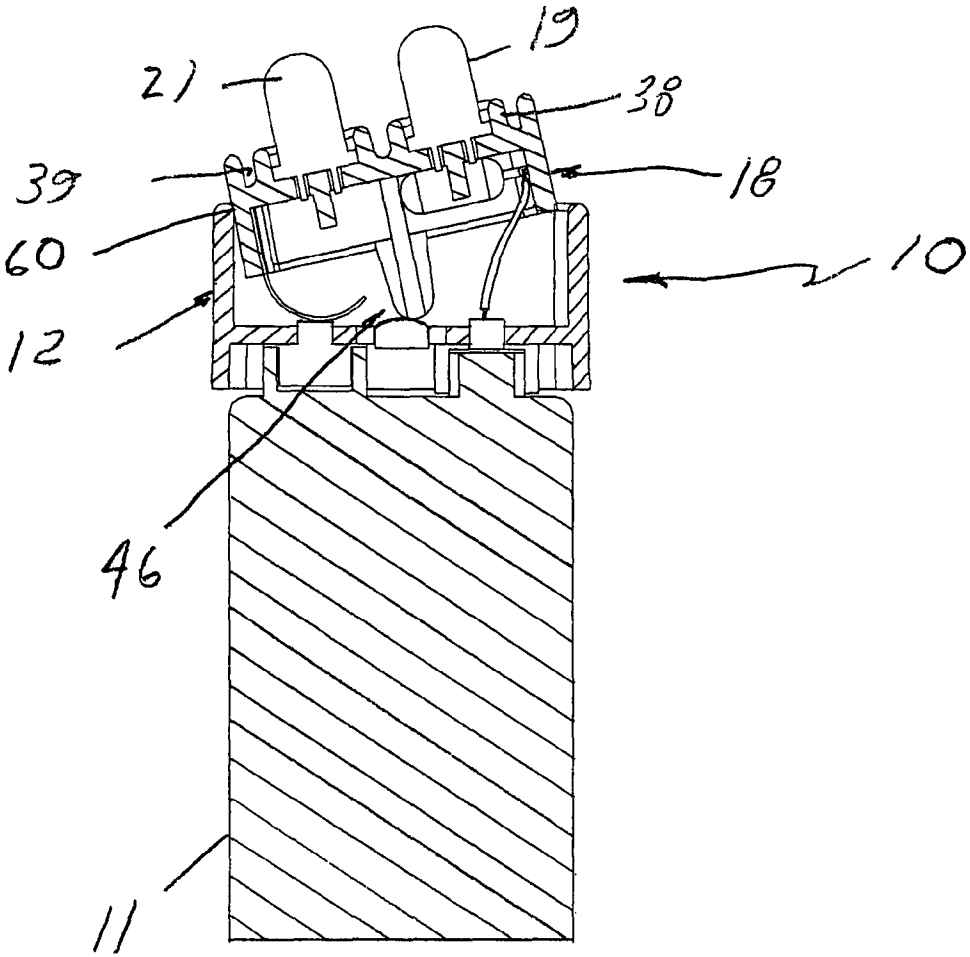
FIG. 4 is a longitudinal section of the light assembly and battery according to the present invention illustrated in the "on" position.
Figure 6:
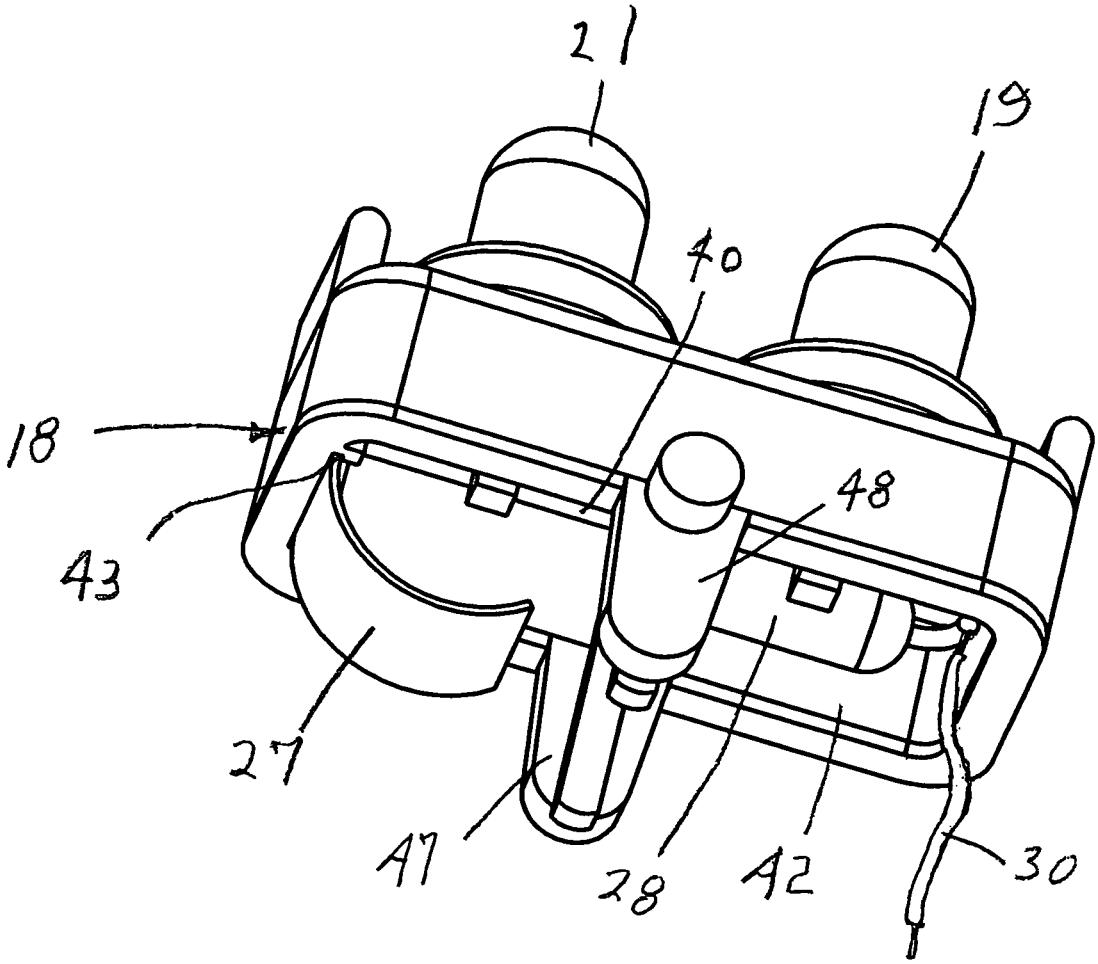
FIG. 6 is a lower perspective of the top housing assembly.

As seen more clearly in FIGS. 3, 4, and 6, the upper housing 18 is also generally rectangular in construction and is sized to fit closely within recess 32 of the lower housing 12 so the upper housing is guided by and stable in the lower housing. The upper surface of the housing 18 has a pair of circular bosses 38 and 39 on transverse wall 40 that each have a pair of holes therein that receive the leads of the LEDs 19 and 21. The LEDs 19 and 21 are glued in the recesses formed by the bosses 38 and 39.

As seen more clearly in FIG. 6, the bottom of the upper housing 18 has a rectangular recess 42 therein and has a vertical adjacent slot 43 into which the "J" contact 27 is press-fitted. Resistor 28 is glued to the bottom surface of the transverse wall 40.

Figure 5:
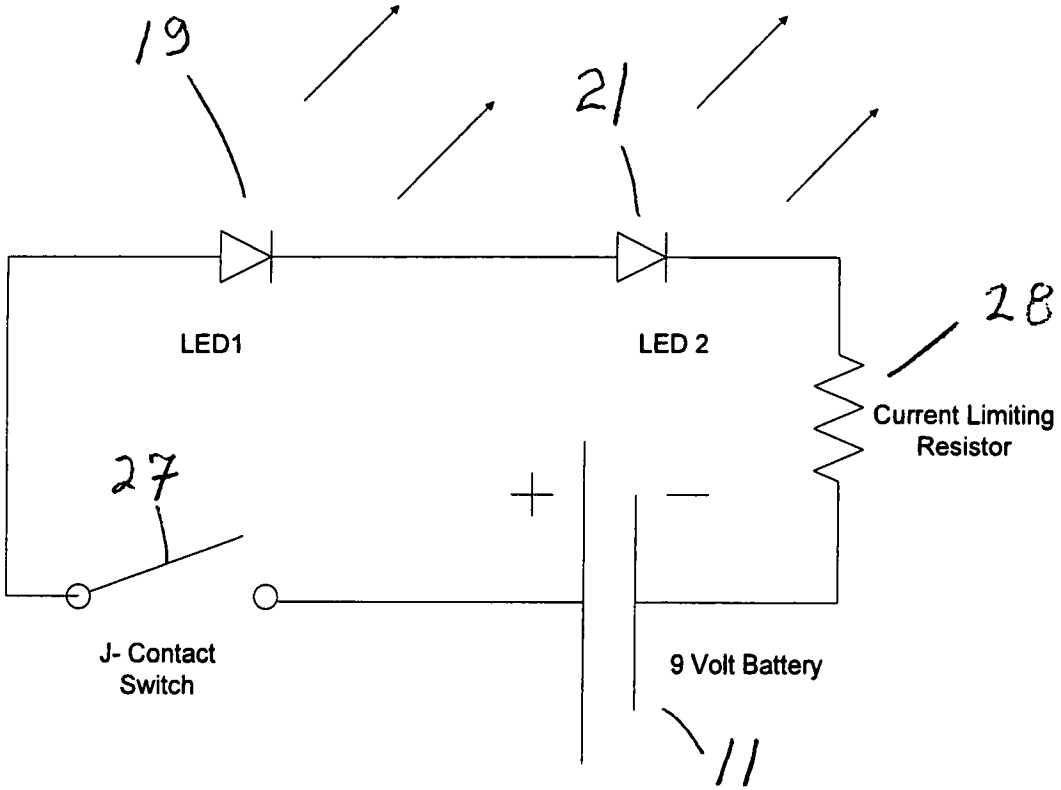
FIG. 5 is a circuit illustrating the LEDs, switch, and 9-volt battery and resistor in series configuration.

One end of the wire 30 is soldered to the right end of the resistor 28 as illustrated in FIG. 6, while the second lead of resistor 28 is soldered to the first lead of LED 19. The second lead of LED 19 is soldered to the right lead of LED 21. The second lead of LED 21 is soldered to the top of the "J" contact 27. This circuit configuration is illustrated in FIG. 5 showing the LEDs 19 and 21 in series with each other, in series with the resistor 28, and in series with "J" contact switch 27 and 9-volt battery 11.

It should be noted that the lower end of wire 30 is soldered to the contact 14 prior to assembly of the upper housing 18 into the lower housing 12.

As seen in FIGS. 3 and 4, the upper housing 18 is maintained in its on and off positions by a detent mechanism 46 that includes a pair of integral rigid prongs 47 and 48 integral with and downwardly depending from the lower reach of the upper housing 18. The lower end of one of the prongs 47 and 48 engages and passes over a spring detent 50 formed integrally with the lower housing 12.

As seen in FIG. 8, the spring detent includes an upper arcuate projection 51 that is cantilevered on lower portion side wall 54 by spring portion 52 in a recess or opening 55 in lower housing transverse wall 34. Thus, as one of the prongs 47 and 48 engages the detent projection 51, the detent projection 51 springs downwardly and then back upwardly as the prong passes thereover securely holding the upper housing 18 in its "off" position in FIG. 3 where upper housing 18 engages the lower housing against the upper housing recess at point 58 to lock the upper housing in its "off" position.

Similarly, as the light assembly is switched or rocked to its "on" position in FIG. 4, the detent assembly 46 locks the upper housing against the lower housing recess at point 60 thereby locking the upper housing 18 in its "on" position.

The user shifts the light assembly from its "off" position shown in FIG. 3, to its "on" position by hand-grasping and placing the thumb against the upper reaches of the upper housing 18 adjacent the LED 21 and pushing downwardly, rotating the upper housing 18 from a position shown in FIG. 3 to the "on" position shown in FIG. 4. Conversely, the light assembly 10 is switched from the "on" position of FIG. 4 to the "off" position of FIG. 3 by hand-grasping the battery 11 and light assembly 10 pushing downwardly with one's thumb on the upper housing adjacent the LED 19 and pushing downwardly rotating the housing assembly 18 clockwise from the position shown in FIG. 4 to the position shown in FIG. 3.

The invention claimed is:

1. A 9-volt battery mounted flashlight where the battery has a body with a longitudinal axis and the top of the body has spaced positive and negative terminals, comprising: a bottom housing assembly having spaced positive and negative terminals designed to be held in place by the positive and negative terminals on the 9-volt battery, a top housing assembly mounted on the bottom housing assembly and carrying at least one LED, said top housing assembly having a contact selectively movable into electrical continuity with one of the bottom housing terminals, and said top housing being movably mounted on said bottom housing assembly to selectively move the top housing assembly contact into and out of electrical continuity with said one of the bottom housing terminals to switch the flashlight on and off without the need for any external switch.

2. A 9-volt battery mounted flashlight as defined in claim 1, wherein the bottom housing assembly is generally rectangular with a longitudinal axis and has a generally rectangular recess for receiving the top housing assembly, said top housing assembly being pivotally mounted in the recess in the bottom housing to effect movement of the top housing contact.

3. A 9-volt battery mounted flashlight as defined in claim 1, including a resistor in the top housing assembly to adjust the voltage to the LED.

4. A 9-volt battery mounted flashlight as defined in claim 1, wherein the contact in the top housing assembly is a "J" shaped contact selectively engageable with said one housing terminal.

5. A 9-volt battery mounted flashlight as defined in claim 1, wherein the top housing assembly has integral pivot bosses engaging in pivot openings in the bottom housing.

6. A 9-volt battery mounted flashlight as defined in claim 1, wherein the top housing assembly and the bottom housing assembly have interengaging detent mechanisms to hold the flashlight in either an on or an off position.

7. A 9-volt battery mounted flashlight as defined in claim 6, wherein the detent mechanism includes an integral projection on one of the top housing assembly and the bottom housing assembly and an integral spring on the other assembly.

8. A 9-volt battery mounted flashlight as defined in claim 1, wherein the bottom housing assembly is wider than the battery body.

9. A 9-volt battery mounted flashlight as defined in claim 1, wherein the top housing assembly is pivotally mounted on the bottom housing assembly about an axis perpendicular to the longitudinal axis of the battery.

10. A 9-volt battery mounted flashlight where the battery has a body with a longitudinal axis and the top of the body has spaced positive and negative terminals, comprising: a lower one-piece housing generally rectangular in shape having positive and negative terminals designed to engage and be supported on the positive and negative terminals of the battery, said lower housing having a generally rectangular upper recess therein, an upper one-piece housing generally rectangular in shape pivotally mounted between first and second positions in the upper recess in the lower housing, said upper housing having integral pivot bosses engageable with the lower housing, said upper housing carrying an LED energized by the battery, and said upper body having a contact connected to the LED selectively engageable with one of the lower housing terminals to turn the LED on and off as the upper housing is pivoted relative to the lower housing without the need for any external switch.

11. A 9-volt battery mounted flashlight as defined in claim 10, wherein the lower housing is wider than the battery body.

12. A 9-volt battery mounted flashlight as defined in claim 10, wherein the upper housing is pivotally mounted on the lower housing about an axis perpendicular to the longitudinal axis of the battery.

13. A 9-volt battery mounted flashlight as defined in claim 10, wherein the contact is a metallic strip in the shape of a "J".

14. A 9-volt battery mounted flashlight as defined in claim 10, including a detent mechanism between the lower housing and the upper housing to hold the upper housing in the on or off position including an integral spring bar on the lower housing and an interengageable integral downward projection on the upper housing.

15. A 9-volt battery mounted flashlight where the battery has a body with a longitudinal axis and the top of the body has spaced positive and negative terminals, comprising: a lower housing having first and second terminals connectable to the battery terminals, and an upper housing carrying an LED movably mounted on the lower housing to turn the flashlight on and off without the need for any external switch.

* * * * *